United States Patent [19]

Mariani

[11] 4,291,714

[45] Sep. 29, 1981

[54] HAIR CURLER

[76] Inventor: Rodolfo Mariani, 27, Corso Saffi, Faenza, Italy

[21] Appl. No.: 117,713

[22] Filed: Feb. 1, 1980

[51] Int. Cl.[3] ..... A45D 2/00

[52] U.S. Cl. ..... 132/40

[58] Field of Search ..... 132/40, 41, 42, 39

[56] References Cited

U.S. PATENT DOCUMENTS

| | | | |
|---|---|---|---|
| 2,430,766 | 11/1947 | Gregory | 132/40 |
| 2,750,948 | 6/1956 | Lutz | 132/40 X |
| 2,769,449 | 11/1956 | Portell | 132/42 R |
| 2,781,047 | 2/1957 | Whitehill | 132/40 |

*Primary Examiner*—G. E. McNeill

[57] ABSTRACT

The hair curler consists of a cage-like element having a spheroidal shape divided into two hemispheres along an equatorial plane. The two hemispheres are connected to one another in a manner permitting relative rotation by means of an inner core. One hemisphere is provided in its polar zone with a hairpin for resiliently clamping the base portion of a lock of hair and the two hemispheres present a crescent-shaped opening into which the lock clamped by the hairpin is inserted. A hair lock retainer is further provided in the crescent-shaped opening in the hemisphere opposed to the hemisphere carrying the hairpin, so that the hair lock, once it has been clamped by the hairpin and inserted into the opening, cannot escape from same.

At the interior of the cage-like element there is arranged, aligned with the polar axis of the hair curler, an axial core connecting the two poles of the spherical cage, so that an annular chamber is defined between the inner walls of the cage and the outer surface of the axial core. After the lock has been clamped by the hairpin at one polar end of the hairpin, and inserted into the opening, one hemisphere is rotated in the desired direction, so that the lock is compelled to wind itself onto the axial core and is progressively drawn into the annular chamber at the interior of the hair curler.

7 Claims, 5 Drawing Figures

HAIR CURLER

SUMMARY OF THE INVENTION

The present invention relates to a hair curler for the curling of locks of hair, as required in permanent set or hair-wave treatment with drying effected preferably by using a warm air hair dryer.

The hair curler constructed in accordance with the present invention presents among others the following advantageous features:

(1) It permits curling of the hair lock in both directions (ambidextrous);

(2) It can be set in place very quickly and without the need for supplemental tools;

(3) It favors the formation of a curled hair lock which is softer at its base or root portion (near the scalp) and is more accentuated towards the terminal portion, as is often required;

(4) It can be produced at a very low cost.

The hair curler according to the invention substantially consists of a cage-like element having a spheroidal or any other similar shape, and which is divided into two halves along an equatorial plane, said two halves being connected to one another in a manner permitting rotation of the one relative to the other and with respect to a common polar axis, by means of an inner core. One hemisphere is provided in its polar zone with a hairpin or comb element for resiliently clamping the base or root portion of the hair lock, i.e., the portion of the hair lock which is nearer to the scalp, and the two hemispheres are provided with a crescent-shaped opening according to the meridian direction, into which opening there is inserted the lock by its portion immediately adjacent to said base portion clamped by the hairpin or comb element. Lock retainer means are further provided in the said meridian opening in the hemisphere opposed to the hemisphere carrying the said hairpin or comb element, so that the hair lock, after it has been clamped by the hairpin and inserted into the meridian opening, cannot escape from same.

At the interior of the cage-like element forming the hair curler there is arranged, aligned with the polar axis of the hair curler, an axial core, usually in the form of a cylindrical tubular member connecting the two poles of the spherical cage, so that between the inner walls of the cage and the outer surface of the axial core there is defined an annular chamber into which the base or root portion of the hair lock is inserted through the opening, as above described. Once the lock has been clamped by the hairpin element at one polar end of the hairpin, and inserted into the opening, from which it cannot escape thanks to the retainer means provided in the hemisphere opposed to the hemisphere presenting the hairpin element, then the said hemisphere is rotated in the desired direction, so that the lock is compelled to wind itself onto the said axial core and is progressively drawn at the interior of the hair curler, into the annular chamber, inside which chamber it remains encaged for all the time required for its curling treatment.

BRIEF DESCRIPTION OF THE DRAWINGS

The hair curler according to the invention will now be described with reference to the attached drawings, in which.

DESCRIPTION OF THE PREFERRED EMBODIMENT

Figure 1:
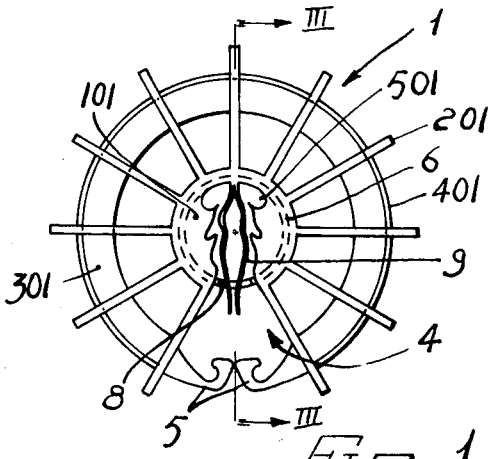
FIG. 1 is a plan view of the hair curler.
Figure 2:
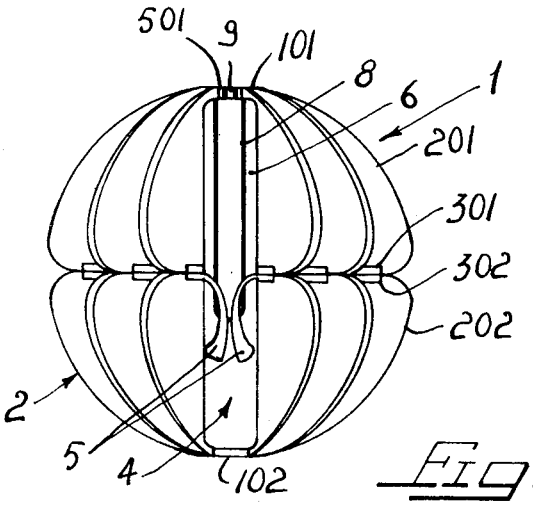
FIG. 2 is a side elevation.
Figure 3:
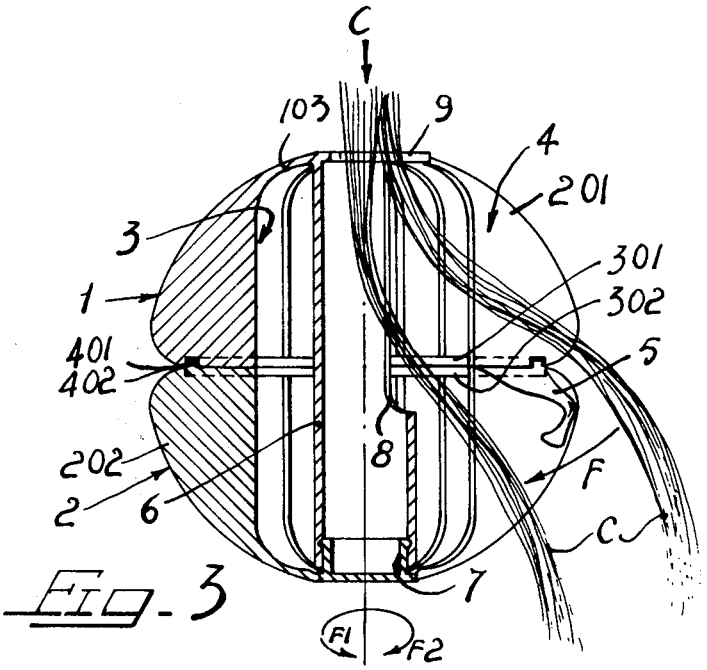
FIG. 3 is an enlarged section view of the curler along line III—III of FIG. 1, during use.
Figure 4:
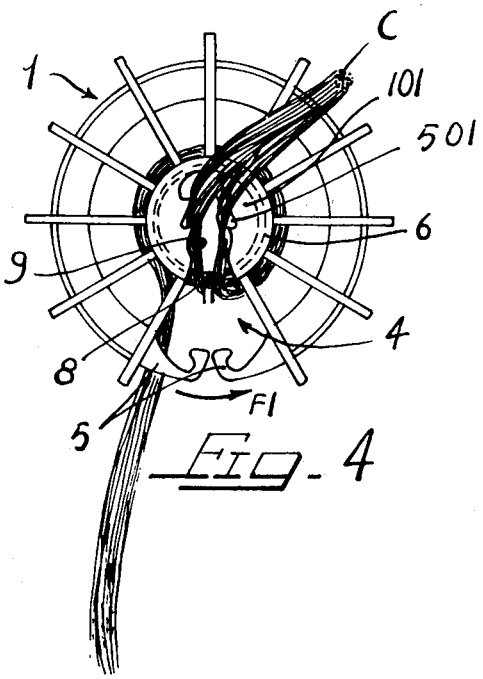
FIG. 4 is a plan view of the curler identical to that of FIG. 1, during use.

With particular reference to FIGS. 1 to 3, it is to be noted that the hair curler according to the invention consists of a sort of spheroidal cage which is subdivided along an equatorial plane into two halves or hemisphere, respectively indicated by reference numerals 1 and 2. Each hemisphere comprises a polar cap 101, 102 from which diverge, in meridian directions and at equispaced angular intervals, a plurality of ribs or wings 201, 202 which define exteriorly the outer surfaces of the two hemispheres. The said meridian ribs 201, 202 are integral with respective rings 301, 302 in the said equatorial plane. From FIG. 3 it can be noted that one of the said rings, e.g., ring 301, has an annular concentric step 401 which, upon assembly of the two hemispheres 1 and 2 (to be described hereinbelow), slidably engages a corresponding annular concentric groove 402 provided in the ring 302. In this manner there is obtained, upon assembly of the two hemispheres, a more precise co-axiality of same, and inadvertent insertion, during use of the device, of some hairs of the hair lock between the two rings 301, 302 is avoided. The two hemispheres 1 and 2 are rotatably connected to one another by means of an inner axial tubular core 6, which is integral with and extends, for instance, from the polar cap 101 of hemisphere 1 and engages, in the assembled condition of the hair curler, a cylindrical bushing 7 provided on the inner side of the opposed polar cap 102 of hemisphere 2. The engagement between axial core 6 and cylindrical bushing 7 may be obtained by means of a snap connection (e.g., an annular recess at the interior of core 6, cooperating with an annular flange on the exterior of bushing 7) so that the two hemispheres 1 and 2 can rotate freely with respect to one another in either direction. Each hemisphere 1, 2 has an interruption in the meridional direction, which interruption concerns the cage-like surface (and results from the absence of at least one meridional rib 201, 202) as well as the two rings 301, 302, so as to define, in the assembled condition of the hair curler, a meridian crescent-shaped opening 4 which leads to the interior of the cage-like enclosure, to the annular cylindrical chamber 3 defined between the outer cylindrical surface of axial core 6 and the inner side wall of the cage delimited by the inner edges of ribs 201, 202.

The hemisphere 1 carrying the axial core 6 is provided at its polar cap 101 with hair clamping means such as a hairpin or comb element 9 housed in a suitably recessed and shaped area 501 of the said polar cap and directed into the space defined by the opening 4. The axial core 6 has a longitudinal slot 8 starting at the polar cap 101 and terminating at some distance beyond the equatorial disc 301, said slot 8 opening in the same direction as the meridional opening 4 and the free extremities of the hairpin or comb element 9. The other hemisphere 2 is provided, at opening 4, with hair lock retainer means consisting of two suitably shaped resilient appendages 5 originating from the equatorial ring 302 at the two points of interruption at the opening 4. The said hair lock retaining means 5 and the corresponding half-crescent opening 4 in the hemisphere 2 define the hair lock engaging and guide means, capable of being rotated about the axial core 6.

The operation of the just described hair curler is evident. The two hemispheres of the assembled hair curler (said assembly resulting from the snap-connection of the two hemispheres 1 and 2, permitting relative rotation about the polar axis) are relatively rotated with respect to one another so as to bring the meridional openings 4 into alignment and create a single cresent-shaped opening 4.

The base or initial portion (near the scalp) of the hair lock is then clamped by the hairpin or comb 9, and then the lock C is introduced through the aperture 4 into the annular chamber 3 of the cage of the hair curler, as indicated by arrow F in FIG. 3. The longitudinal slot 8 in the axial core 6 favors the said introduction of the lock C and its safe clamping by the hairpin 9. The hair lock C is retained at the inside of the hair curler by the retaining means 5, which will resiliently close the aperture 4 immediately after the passage of the lock. At this point, the hemisphere 2, opposite to the hemisphere 1 which is practically anchored to the base of the lock, is rotated in the desired direction, depending from the required curler (see arrows F1 and F2) around its polar axis and with respect to the said anchored fixed hemisphere 1. By this rotation, the hair lock C is guided into rotation by the above described hair lock engaging and guide means, and is compelled to wind itself on the axial core 6, so that it is progressively drawn to the interior of the hair curler, into the annular chamber 3, inside which chamber it remains engaged for all the time necessary for its curling treatment.

Figure 5:
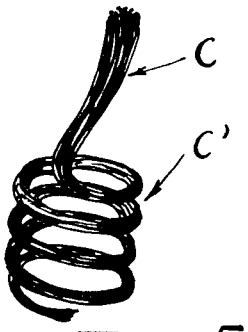
FIG. 5 is a perspective view showing one type of curled hair lock obtainable by use of the hair curler according to the invention.

Once the treatment has been completed, the hair lock is simply pulled out of the hair curler. The resulting curled hair lock is illustrated in FIG. 5, for which it is apparent that the initial or base portion C of the hair lock has a soft wave, while the remaining length of the hair lock C' presents a more accentuated curling, as required in this type of hair treatment.

It will be evident that the cage construction of the hair curler, obtained by the ribs or wings 102, 202, permits perfect treatment of the curled hair lock wound on the axial core at the interior of the curler, by allowing the passage of warm air and other treatment fluid substances through the curler. Moreover, the hair lock is wound on the axial core without any undue stress or tensioning, and is housed at the interior of the annular chamber 3 with sufficient space to expand, particularly in the drying phase of the treatment.

In addition, the cage construction provided by the ribs 201, 202 permits the operator to obtain a better grip on the hair curler.

Many variations and modifications can be made within the scope of the invention. For example the two hemispheres 1 and 2 can be constructed as continuous spherical surfaces provided with aeration bores. The hair curler need not have a spherical shape but may be oblong, of elliptical or cylindrical cross section. The rotatable connection between the two hemispheres can be obtained by means of the two equatorial rings 301, 302. Further, the hemisphere 1 having the hair lock clamping means 9 thereon can be reduced to a minimum, practically to a cap-like element having sufficient dimensions to be gripped by the operator. Also, the axial core 6 may have a shape different from the illustrated cylindrical one; for example, it may be conical, in order to obtain a curled hair lock with peculiar curling. The above and other variations will be apparent to a person skilled in the art. It may be further added that the illustrated hair curler is preferably constructed, for practical and economic reasons, of suitable plastic material, but any other material, such as for example metal, can be employed.

I claim:

1. A hair curler for the curling treatment of a hair lock, comprising:

(a) an axial core having clamping means at one of its ends for clamping said hair lock at its base portion;

(b) hair lock engaging and guide means arranged for rotation around said axial core;

(c) a cage-like element at least partly surrounding said axial core, thus defining an annular chamber for receiving said hair lock curled around said axial core, following rotation of said hair lock engaging and guide means;

(d) said cage-like element comprising two hollow hemispheres each having a polar cap and being rotatably connected to one another to define a substantially spherical cage, said axial core being contained within said cage and rotatably joining by its ends said polar caps of said hemispheres, each of said hemispheres having a side opening having two edges extending along meridional lines and angularly spaced from one another, so that the edges of the opening in one hemisphere can be aligned, by relative rotation of said hemispheres, with the edges of the opening in said other hemisphere, thus defining a crescent shaped opening, the opening of the hemisphere opposite the end of said axial core carrying said clamping means being closed by resilient closure members which can be opened towards the interior of said cage, said opening with said closure members defining said hair lock engaging and guide means.

2. A hair curler according to claim 1, wherein said hair lock clamping means provided at one end of said axial core comprises a comb.

3. A hair curler according to claim 1, wherein said lock clamping means provided at one end of said axial core comprises a hairpin element.

4. A hair curler according to claim 1, wherein each hemisphere of said cage-like element comprises a plurality of angularly spaced, meridionally disposed ribs secured at one end to the respective polar cap of said hemisphere, and at the other end to an equatorial ring, said equatorial ring being interrupted at said crescent-shaped opening.

5. A hair curler according to claim 4, wherein said resilient closure members provided on one hemisphere comprise appendages projecting from the interrupted ends of the equatorial ring of said hemisphere, said appendages normally closing said crescent-shaped opening, but being diverted by lateral movement of said hair lock inwardly into said crescent-shaped opening.

6. A hair curler according to claim 1, wherein said axial core is secured to the inner side of the polar zone of said hemispheres of said cage-like element, with said hair lock clamping means arranged at said polar cap, said axial core extending beyond the equatorial plane of its hemisphere and having at its other end means for rotatable connection with the inner side of the polar cap of said other hemisphere.

7. A hair curler according to claim 6, wherein said axial core has at its free end, opposed to the end secured to said polar cap of said one hemisphere, a tubular cylindrical portion provided with an inner annular projection, while said other hemisphere has on the inner side of its polar cap a cylindrical step with an annular groove, whereby the rotatable connection between the two hemispheres is obtained by snapfitting said tubular end of said axial core onto said cylindrical step.

* * * * *